US006659921B2

(12) United States Patent
Vernon

(10) Patent No.: US 6,659,921 B2
(45) Date of Patent: Dec. 9, 2003

(54) RESISTIVE EXERCISE DEVICE

(76) Inventor: Douglas K. Vernon, 7720 SW. Bel Air Dr. #10, Beaverton, OR (US) 97008

( * ) Notice: Subject to any disclaimer, the term of this patent is extended or adjusted under 35 U.S.C. 154(b) by 18 days.

(21) Appl. No.: 10/036,837

(22) Filed: Dec. 31, 2001

(65) Prior Publication Data

US 2003/0125170 A1 Jul. 3, 2003

(51) Int. Cl.[7] ..... A63B 21/02
(52) U.S. Cl. ..... 482/124; 482/118; 482/114
(58) Field of Search ..... 482/82, 74, 121, 482/122, 131, 114, 115, 124, 139, 118, 119

(56) References Cited

U.S. PATENT DOCUMENTS 1,402,179 A 1/1922 Pixcitelli
4,335,875 A 6/1982 Elkin
4,441,707 A 4/1984 Bosch
5,306,222 A * 4/1994 Wilkinson ..... 482/124
5,328,432 A 7/1994 Gvoich
5,514,059 A 5/1996 Romney
5,681,248 A 10/1997 Vani
5,916,070 A 6/1999 Donohue
5,993,362 A * 11/1999 Ghobadi ..... 482/124
6,244,998 B1 6/2001 Hinds
6,436,011 B1 * 8/2002 Cook ..... 482/69

* cited by examiner

*Primary Examiner*—Glenn E. Richman

(57) ABSTRACT

An exercise harness has a plurality of attachment points positioned on a waist element and a shoulder element, a plurality of gripping means, and a plurality of resistive members. Each resistive member includes a first end adapted to be coupled to an attachment point and a second end affixed to a gripping means.

Alternatively, the shoulder element of the exercise harness has a right side and a left side. Each of a plurality of resistive members has a first end and a second end each affixed to a gripping means. Stabilizing means are provided to produce tension in the first resistive member when the other end thereof is pulled. Stabilizing means can be positioned at the user's shoulder and waist regions.

8 Claims, 7 Drawing Sheets

RESISTIVE EXERCISE DEVICE

BACKGROUND OF THE INVENTION

The present invention is related to the field of exercise devices, and more specifically to a resistive exercise device to be used by a person.

A variety of resistive exercise devices use elastic cords or straps that can be pulled and stretched by the user. Such devices typically attach handles to each end of the cord and route a cord behind the user's back. A punching or bench-pressing motion pulls on the two ends of the cord, with the user's body providing an opposing force to the central portion of the cord. The cord is stretched and resistance encountered thereby.

A majority of such devices, such as U.S. Pat. Nos. 4,335,875; 5,328,432; 5,514,1595,681,248; and 6,244,998, include a simple padded sleeve encircling the portion of the cord that would otherwise painfully press into the user's back or neck. Other designs supplement this basic design with structure ranging from a belt (U.S. Pat. No. 4,441,707) to a vest-like garment (U.S. Pat. No. 5,916,070). As well as shielding the user from the elastic cords, the supplemental structure is generally taught to stabilize the internal organs of a jogger and to carry the device on the person when in use.

The handles of a prior art device may be inadvertently released by the user while the resistive member is under tension. Such unintended release can cause the resistive member to abruptly return to its resting-state length, causing the gripping means to strike the user.

Significantly, placement of the cords in the prior art devices is fixed to behind either the user's neck, shoulders or lumbar region. As well, combinations of the various devices, to derive thereby a more flexible arrangement, results in additional weight, complexity, and cost.

The invention will become more readily apparent from the following detailed description, which proceeds with reference to the drawings, in which:

SUMMARY OF THE INVENTION

The present disclosure provides an exercise harness to be worn about the torso of a user. The harness includes a plurality of resistive members, which can be stretched by the user to exercise the musculature of the body. The resistive members are preferably elastic straps or cords.

Grasping the handles and pulling the cords in various directions works the different muscle groups of the body.

The tubes, passing along the back of the user, house the resistive cords and thus prevent the cords from contacting the user and causing abrasions.

DETAILED DESCRIPTION OF EMBODIMENT(S)

Figure 1:
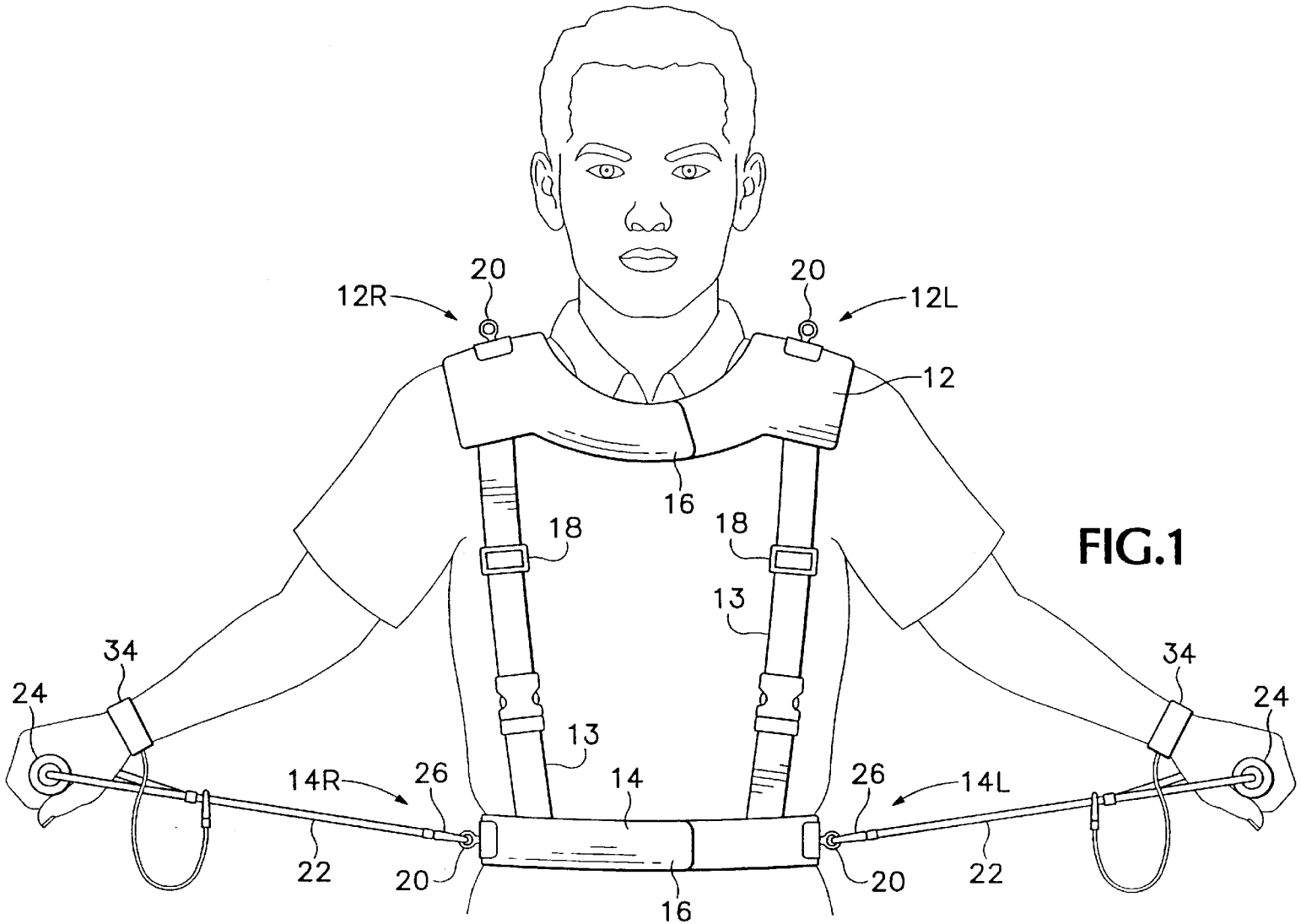
FIGS. 1–2 are front and back views, respectively, of one embodiment of an exercise harness as described herein, worn by a user.
Figure 2:
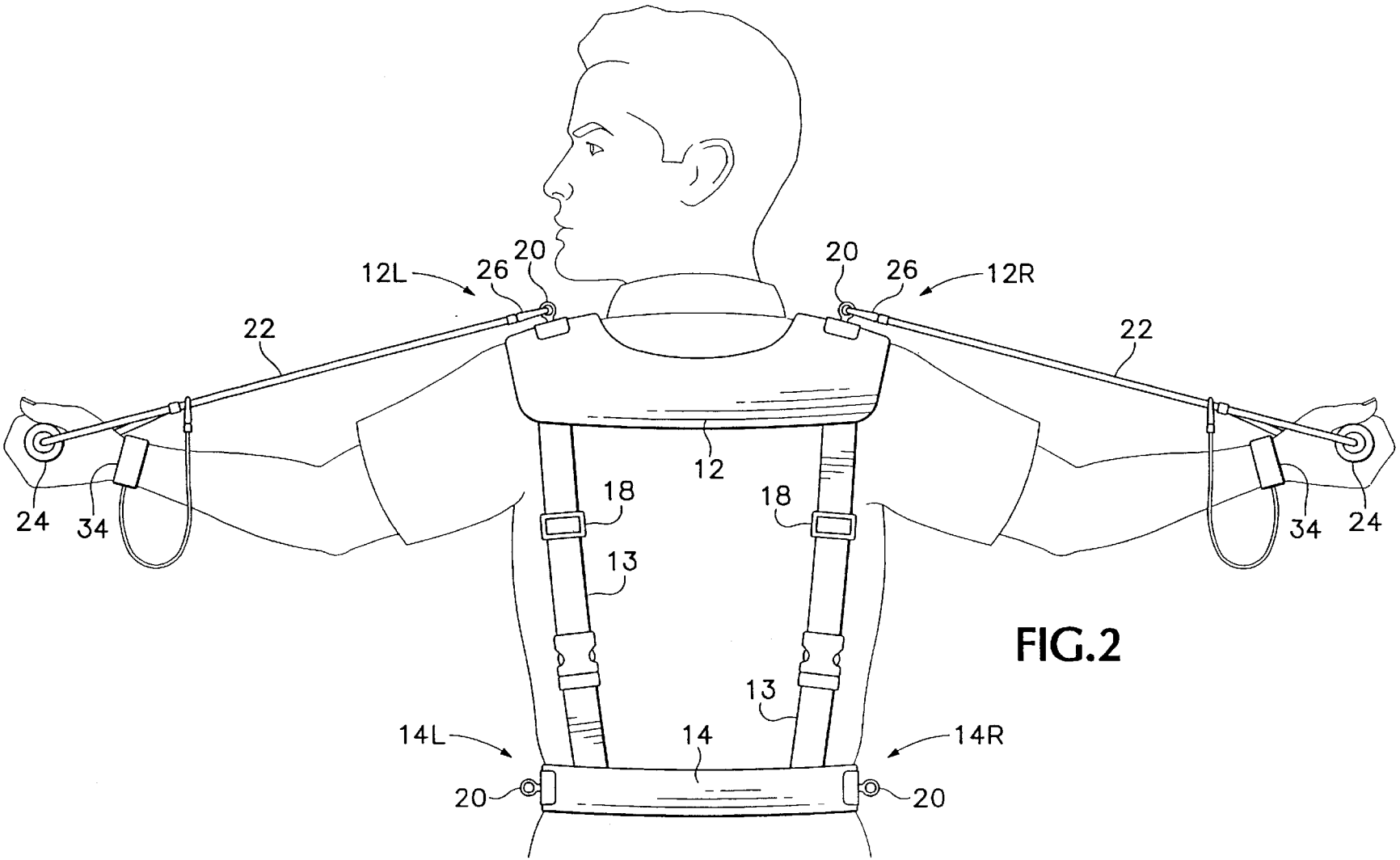

One embodiment of the harness is shown in FIGS. 1–2. The device comprises a shoulder element 12 having right and left sides 12R,12L, and a waist element 14 adapted to encircle the user's waist. The harness is thereby adapted to fit about the torso of a user.

The harness is easily fitted to the user by adjustable closures 16 at the waist member and shoulder members. In the embodiment shown, linking elements 13 couple the shoulder element and the waist element. The linking elements depicted are adjustable by way of buckles 18, further enabling customizing of the harness fit. Straps 13 may be lengthened or shortened to customize the fit to the user.

The harness incorporates four distributed attachment points 20. As shown, two attachment points on the shoulder element are proximate the shoulders of the wearer of the harness, and an additional two attachment points 20 on the waist element are located proximate the hips.

Figure 5:
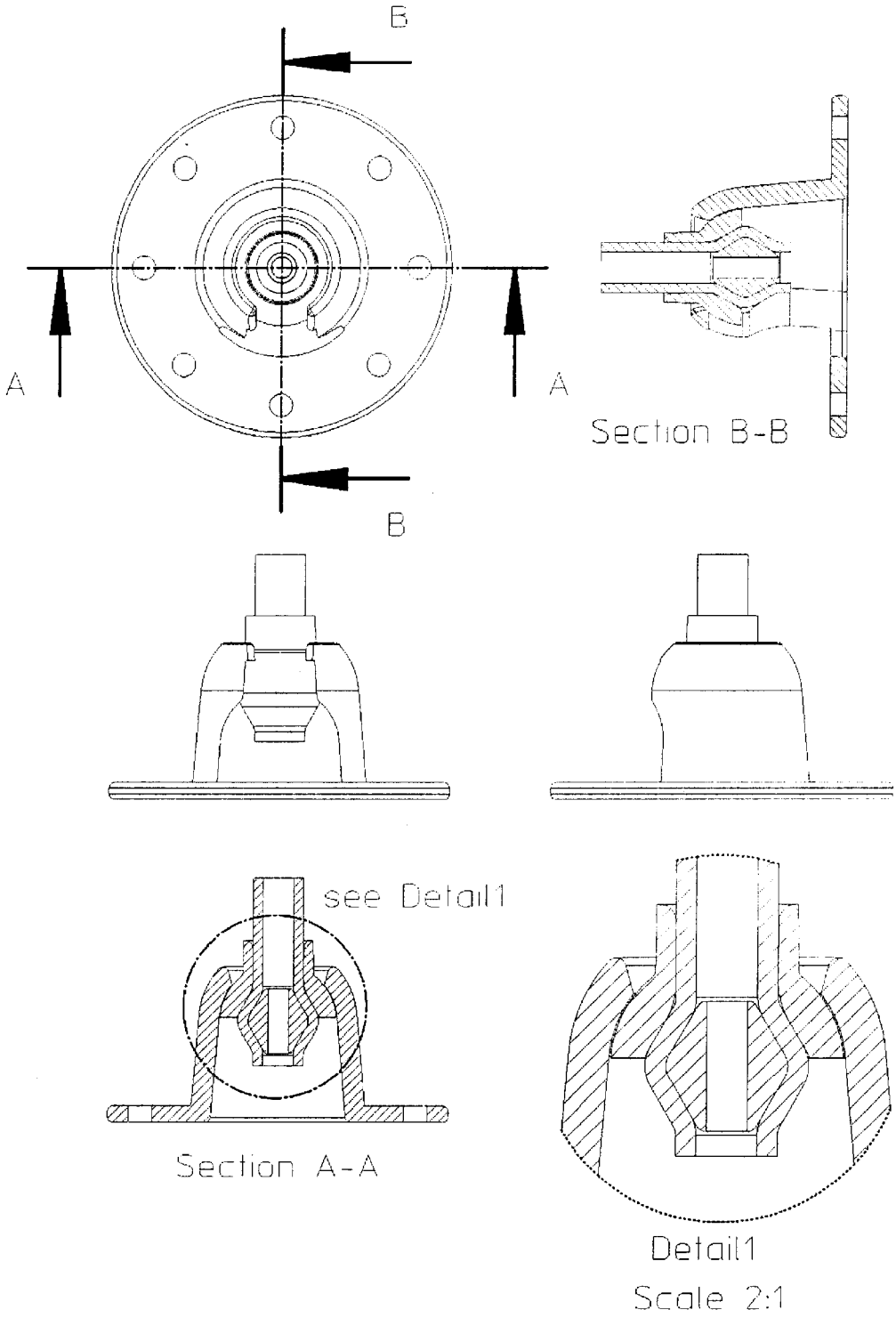
FIGS. 5–6 are diagrams of alternative means for securing the resistive members to the respective attachment points.

A plurality of resistive members 22 are provided. At one end of each of the members is affixed a gripping means 24 (FIG. 5). The gripping means are adapted to be manually grasped by the user.

The resistive members are constructed such that they can be resiliently stretched. For example, the resistive members can be made of elastic, rubber, or various other materials providing the desired resilient character.

Gripping means 24 are shown herein as handles. Alternatively, the gripping means may be structured so as to be secured to the user's hands without the need for the user to affirmatively grasp the means. For example, the gripping means can also be a loop, configured to be positioned around the user's hand such that the loop is between the bases of the thumb and forefinger. So positioned, the gripping means can be securely held by the user whether the hand is open or closed.

As another alternative, the gripping means can be glove-like, with the respective resistive member attached to the gauntlet portion of the glove-like structure. The glove-like means can be donned by the user and remain securely on the hands, while freeing the user's hands for other tasks.

Figure 3:
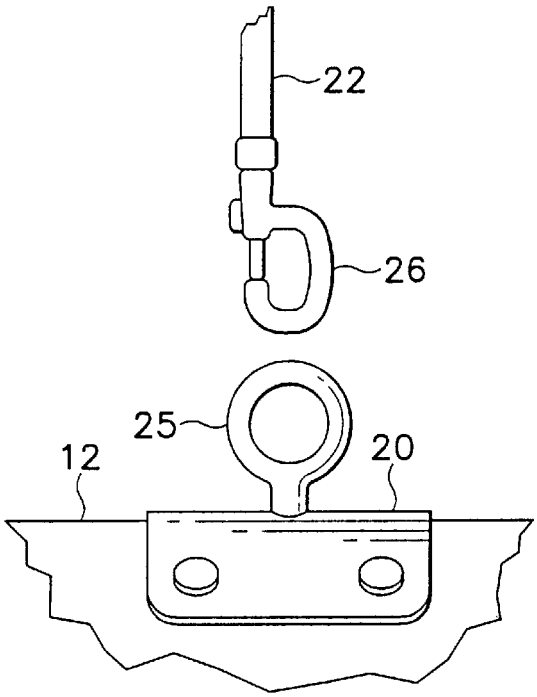
FIGS. 3–4 are front views of embodiments showing the attachment of resistive members to the attachment points.
Figure 4:
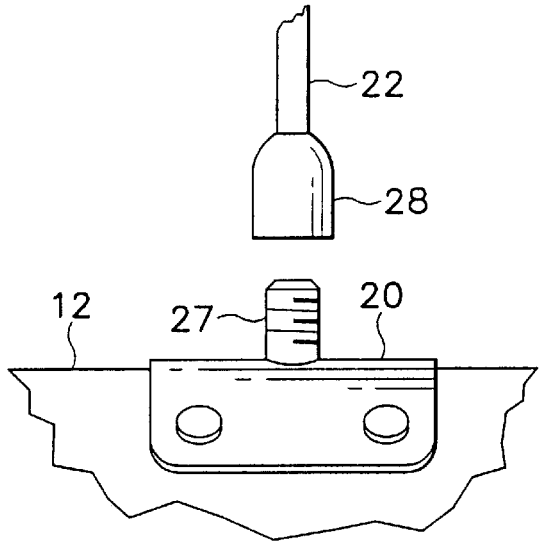

Each resistive member 22 is coupled at the end opposite the gripping means 24 to an attachment point 20. FIGS. 3–4 shows the resistive members configured to be attached to the harness via a clip 26 or a screwtype 28 fastener.

Figure 6:
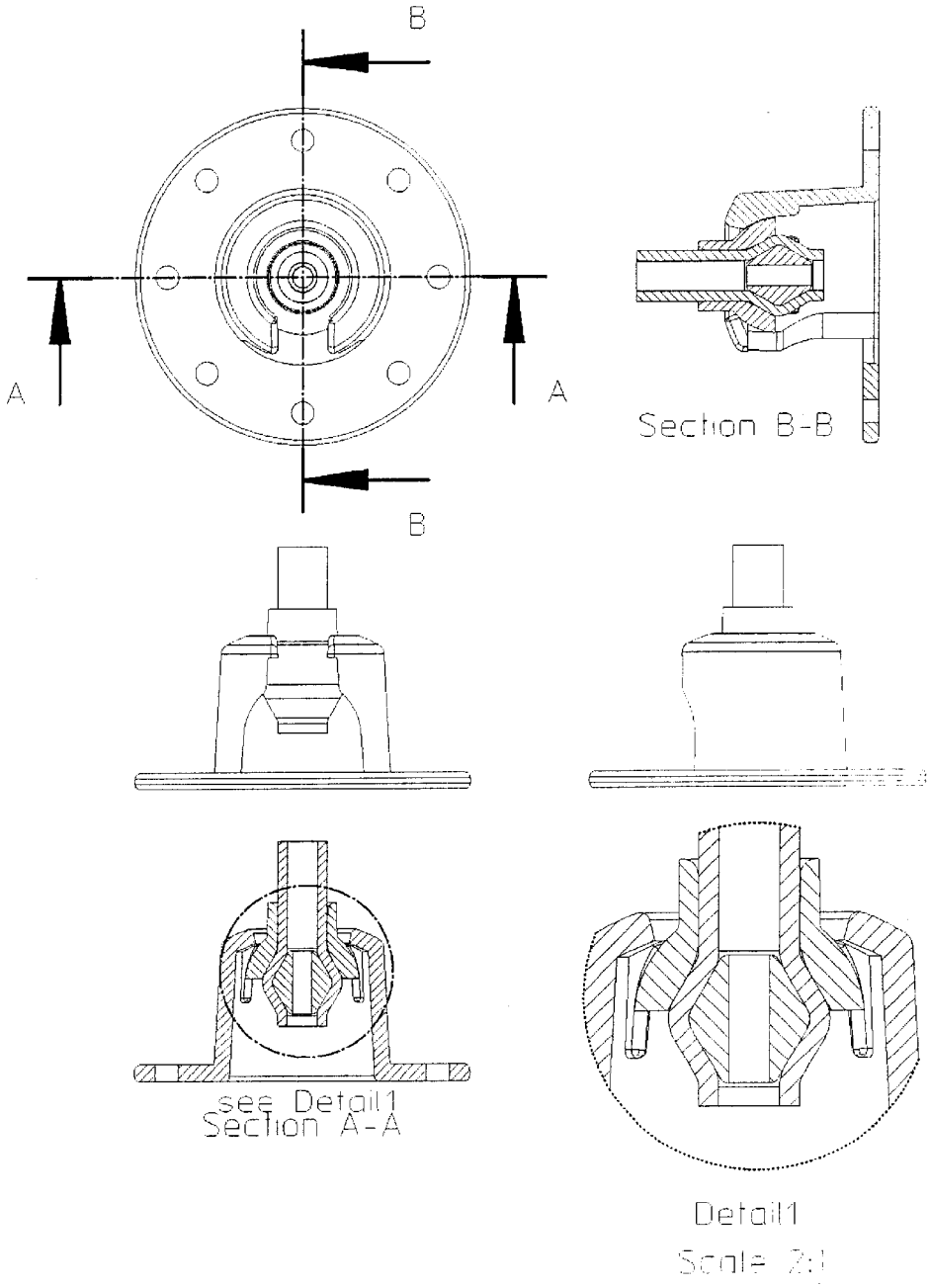

FIGS. 5–6 illustrate alternative structures that can be employed as the means for securing the resistive members to the respective attachment points. The, structures shown are ball-and-socket type connectors. A receiver housing is generally a hollow cylindrical body having an opening at the top and a receiving aperture on one side of the cylindrical body.

Detachably received within the receiver housing is a ball element-type body affixed to the first end of the resistive member. The ball element is inserted through the receiving aperture and is retained within the receiver housing.

In operation (FIGS. 1–2), a user grasps and pulls on one or more gripping means 24. Through this motion, the resistive member 22 attached thereto is stretched, so that the user's motion is met with the resistance of the resistive member. The harness is prevented from moving or twisting about the user's torso by its close and secure fit.

Each resistive member can be actuated independently, permitting the exercise of a single arm without the need for reciprocating tension on the other end of the resistive member actuated.

Figure 7:
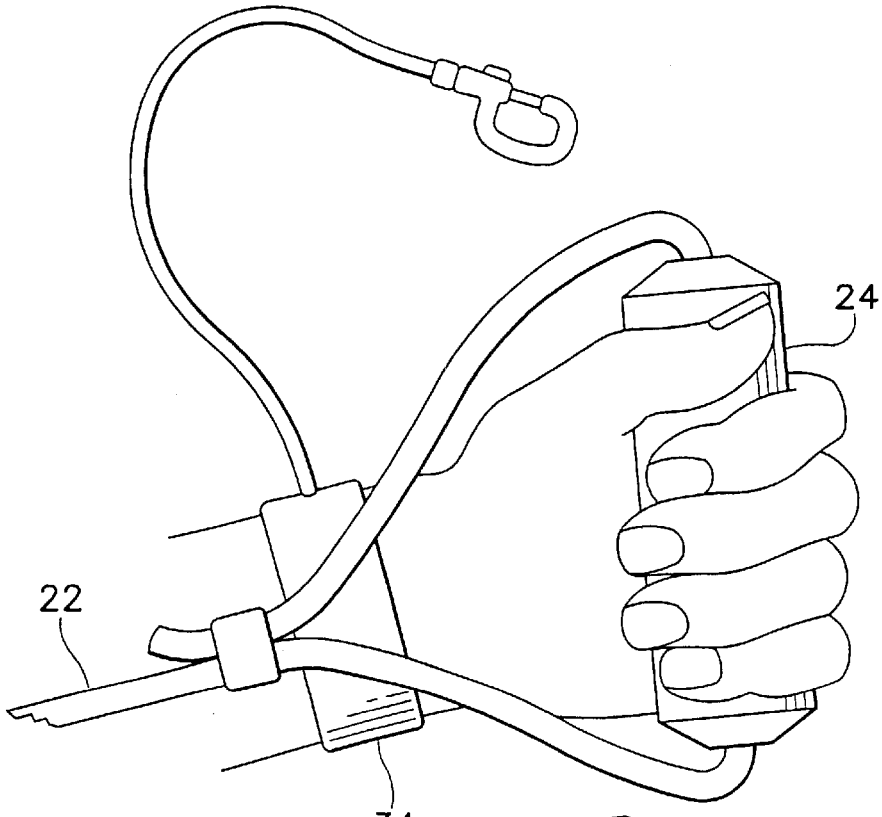
FIG. 7 is a front view of one embodiment of a gripping means and a wrist strap.

In an alternate embodiment shown in FIG. 7, there is included a wrist strap 34 structured to be looped around the user's wrist. The wrist strap further can be coupled to either the gripping means 24 or to the resistive means 22 proximate the gripping means. When so worn, the strap serves to substantially preserve the proximity of the gripping means and the user's hand. "Snap-back" of the resistive member and gripping means is thereby prevented. The wrist strap 34 therefore functions as a safety element to prevent injury that could result when the tensioned resistive member is released accidentally.

As shown in FIGS. 1–2, the shoulder element 12 is a collar- or yokelike structure. The harness can alternatively merge the shoulder element 12 and the linking elements 13 to employ a modified pair of linking elements, wherein the linking elements 13 are of a type similar to straps employed on backpacks and the like.

Such straps attach to the waist element and are structured to be worn over the shoulders. Backpack-type straps can have a transverse member (e.g., 56 in FIG. 10) to secure their positions on the user.

Figure 8:
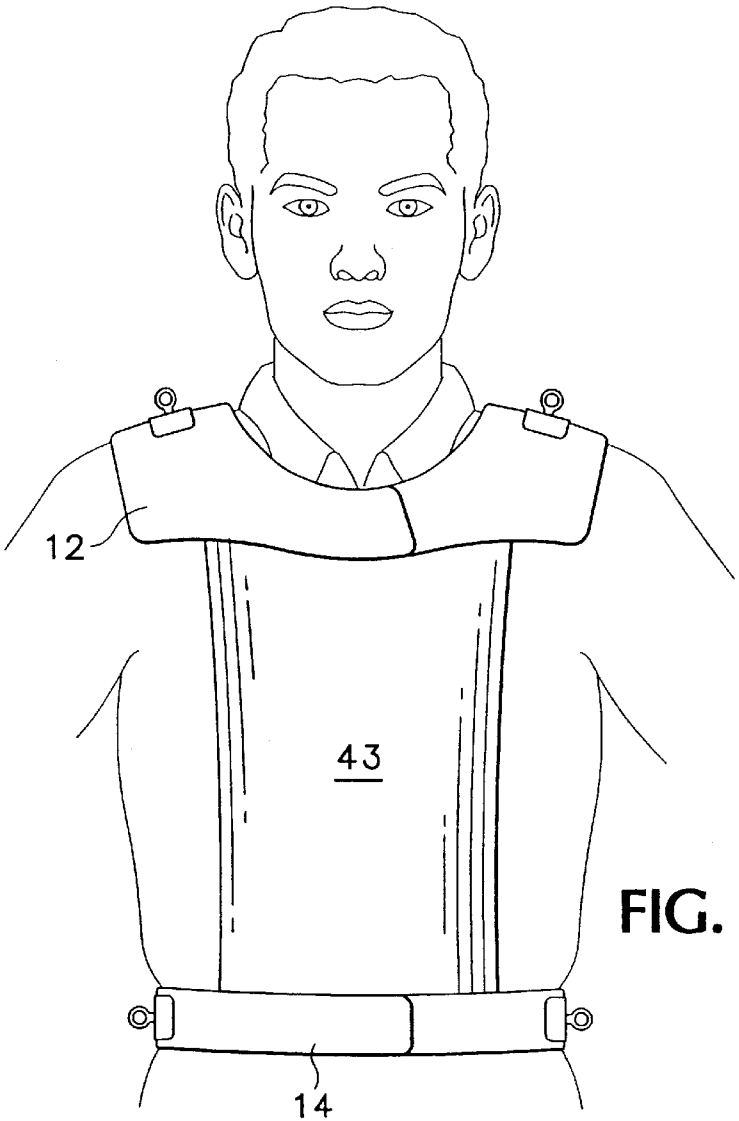
FIG. 8 is a front view of an alternative embodiment of the harness disclosed herein.

Similarly, the linking elements 13 of the preceding embodiment can be replaced with a single linking element 43, as illustrated in FIG. 8. The linking element 43 is preferably widened to increase the fit and security of the harness on the user. This linking element embodiment is adjustably coupled to the waist element 14 and shoulder element 12 similarly to the embodiment described above.

Figure 9:
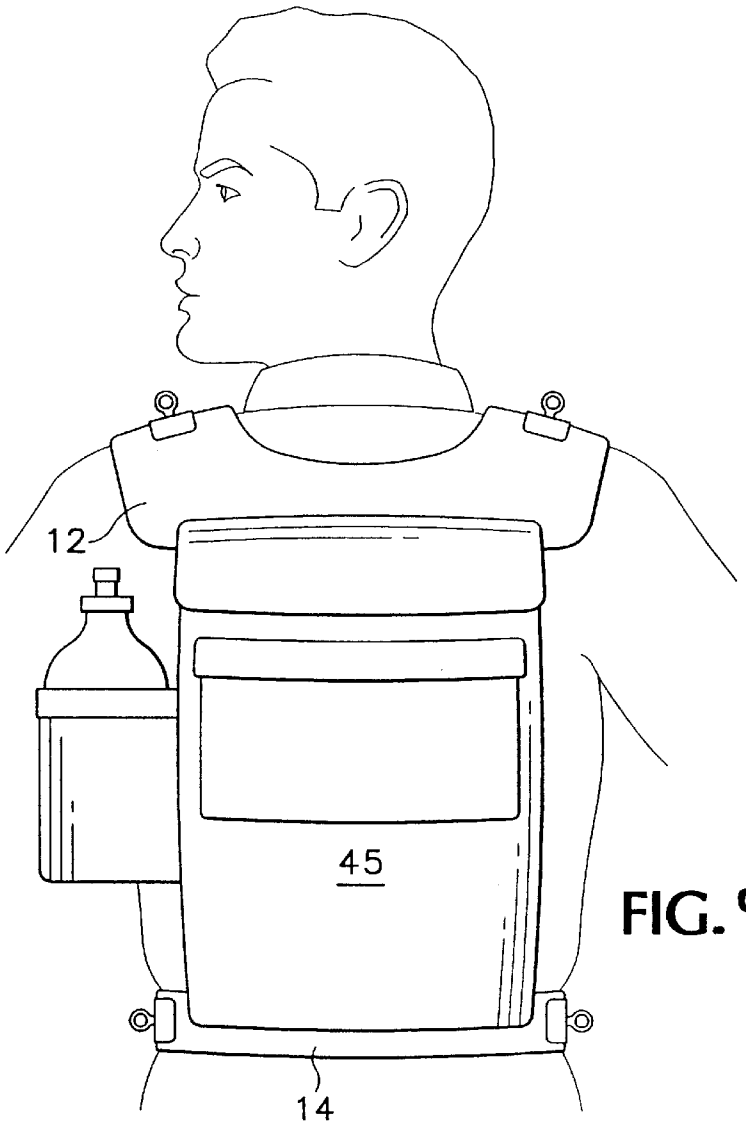
FIG. 9 is a back view of a harness having a compartment.

A harness, especially one constructed with backpack-type straps, can be equipped with a compartment 45 (FIG. 9). The compartment can be attached to the linking elements 13 or linking element 43, preferably on those adapted to be on the user's back when the harness is donned. The compartment is suitable for carriage of items such as a water bottle, towel, foodstuffs, wallet, or other gear.

In a second embodiment, stabilizing means are employed to stabilize one end of the resistive member, so that the resistive member may be tensioned by pulling at its other end.

Figure 10:
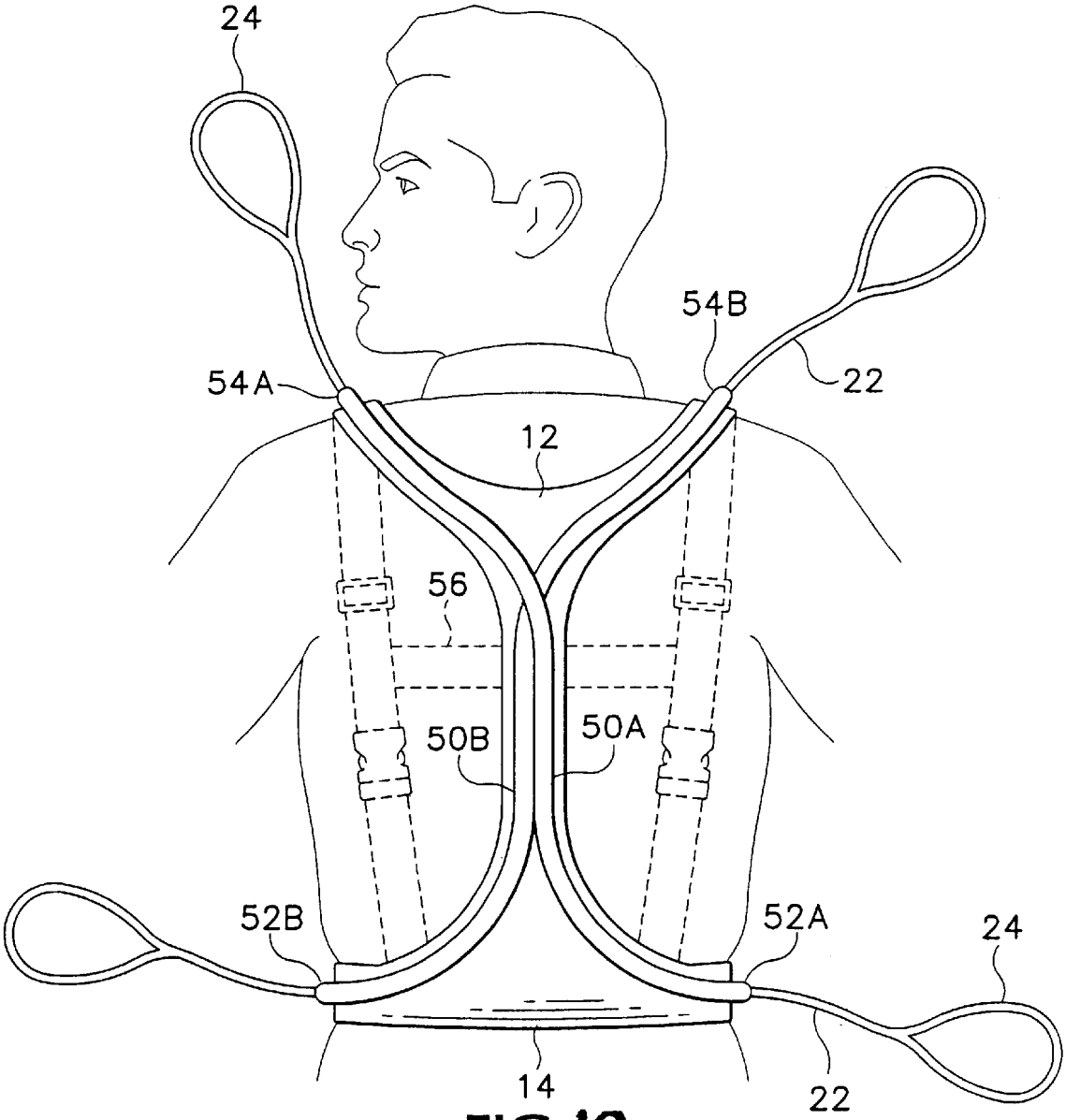
FIG. 10 is a rear view of a second alternative embodiment of an exercise harness as described herein.

As shown in FIG. 10, the stabilizing means are two inelastic nylon tubes 50 disposed on the back of the harness. In one design according to this embodiment, the tubes course diagonally across the back of the harness. The tubes can also be non-overlappingly disposed, e.g., substantially vertically or horizontally.

In the illustrated embodiment, one tube 50A has a first end 52A at the right waist and its other end 54A at the left shoulder; the second tube 50B has ends 52B,54B positioned at the right waist and the left shoulder, respectively. Alternatively, this embodiment can also include a design wherein one tube runs from the right shoulder to the right waist and the other tube from left shoulder to the left waist.

The tubes receive within them resistive cords 22, the latter terminating in gripping means 24. The gripping means are sized to prevent the ends of the resistive cords from being pulled through the nylon tubing, thus providing tension when the opposite end of the resistive cord is activated, i.e., by pulling.

In this embodiment, the tubes 50A–50B provide the leverage for the user to stretch a resistive member 22 by pulling at only one end thereof. The tubes further act as a buffer between the user and the resistive members 22, to prevent undesirable transfer of friction from the stretching resistive members to the user.

Other structures can be used to stabilize the non-activated end of a resistive member. For example, the stabilizing means can be D-rings localized to positions proximate to the tube ends above described. The resistive member can be threaded through the D-rings. The D-ring can be sized to permit unrestricted passage therethrough of the resistive member but, similar to the tube openings above, would exclude from passage therethrough the gripping means.

It can be readily seen that stabilizing means other than tubes can be effectively employed without deviating from the essential teaching disclosed herein. For example, the harness can alternatively contain flat harness members paralleling the resistive members along the user's back and serving to protect the user from the moving resistive members.

As has been mentioned, the harness is worn about the torso. The harness therefore is advantageous over traditional exercise paraphernalia, e.g., barbells or dumbbells, that must be picked up and carried. By contrast, the gripping means are coupled to the harness by way of the resistive members, such that they are carried passively on the harness when not in use.

The exercise harness presents further advantages over prior art in that loose, heavy objects need not be held in the hand when exercising. The use of such gripping means eliminates the risk of dropping such objects. In addition to a handle, the gripping means also can be straps or glove-like structures that can be worn on the hand. Further, the present harness is portable and can be easily conveyed to disparate locations.

The harness of the present disclosure can be worn and operated by the user in a variety of positions, e.g., prone, seated. In fact, the user can operate the harness while engaging in aerobic activities, such as walking, running, or stationary bicycling. The harness is therefore especially suitable for exercise and rehabilitative activities by paraplegics, invalids, and other of limited mobility.

A person skilled in the art will be able to practice the present invention in view of the description present in this document, which is to be taken as a whole. Numerous details have been set forth in order to provide a more thorough understanding of the invention. In other instances, well-known features have not been described in detail in order not to obscure unnecessarily the invention.

While the invention has been disclosed in its preferred form, the specific embodiments thereof as disclosed and illustrated herein are not to be considered in a limiting sense. Indeed, it should be readily apparent to those skilled in the art in view of the present description that the invention can be modified in numerous ways. The inventor regards the subject matter of the invention to include all combinations and sub-combinations of the various elements, features, functions and/or properties disclosed herein.

The invention claimed is:

1. An exercise device, comprising:

a harness adapted to fit about a torso of a user, the harness comprising:

a waist member having a right side and a left side; and a shoulder member having a first side and a second side;

a first resistive member having two ends, each end having coupled thereto a gripping means;

a second resistive member having two ends, each end having coupled thereto a gripping means;

first means for stabilizing the first resistive member at one end to permit tension to be produced in the first resistive member when the other end thereof is pulled, the first stabilizing means comprises a tube having two ends sized to exclude the gripping means from entering, wherein one end of the first tube is positioned proximate the first side of the shoulder member and the other end is positioned proximate the right side of the waist member; and second means for stabilizing the second resistive member at one end to permit tension to be produced in the second resistive member when the other end thereof is pulled, the second stabilizing means comprises a tube having two ends sized to exclude the gripping means from entering, wherein one end of the second tube is positioned proximate the second side of the shoulder member and the other end is positioned proximate the left side of the waist member;

wherein the first resistive member is received within the first tube and the second resistive member is received within the second tube.

2. The exercise device of claim 1, wherein the first side of the shoulder member is adapted to be positioned proximate the right shoulder region of the user and the second side of the shoulder member is adapted is adapted to be positioned proximate the left shoulder region of the user.

3. The exercise device of claim 1, wherein the first side of the shoulder member is adapted to be positioned proximate the left shoulder region of the user and the second side of the shoulder member is adapted is adapted to be positioned proximate the right shoulder region of the user.

4. The exercise harness of claim 1, wherein the waist member comprises a belt and a belt fastener.

5. The exercise device of claim 4, wherein the belt fastener is a buckle-type fastening device.

6. The exercise device of claim 4, wherein:

the first stabilizing means comprises a tube having two ends sized to exclude the gripping means from entering, wherein one end of the first tube is positioned proximate the first side of the shoulder member and the other end is positioned proximate the right side of the waist member;

the second stabilizing means comprises a tube having two ends sized to exclude the gripping means from entering, wherein one end of the second tube is positioned proximate the second side of the shoulder member and the other end is positioned proximate the left side of the waist member; and the first resistive member is received within the first tube and the second resistive member is received within the second tube.

7. The exercise device of claim 1, wherein the first side of the shoulder member is configured to be positioned on the user's right shoulder and the second side of the shoulder member is configured to be positioned on the user's left shoulder.

8. The exercise device of claim 1, wherein the first side of the shoulder member is configured to be positioned on the user's left shoulder and the second side of the shoulder member is configured to be positioned on the user's right shoulder.

* * * * *